United States Patent [19]

Box

[11] 3,997,055

[45] Dec. 14, 1976

[54] FULL DEPTH TRANSPORT CASE HAVING A REMOVABLE SIDE PANEL

[76] Inventor: Theodor M. Box, 1108 Aileen Road, Brielle, N.J. 08730

[22] Filed: Aug. 11, 1975

[21] Appl. No.: 603,300

[52] U.S. Cl. ..... 206/427; 49/463; 206/509; 220/243; 220/329

[51] Int. Cl.[2] ..... B65D 85/80; B65D 45/16

[58] Field of Search ..... 220/331, 307, 332, 241, 220/345, 243, DIG. 15; 206/428, 427, 429, 430, 509, 513; 49/463, 464, 465, 466

[56] References Cited

UNITED STATES PATENTS

| | | | |
|---|---|---|---|
| 2,570,714 | 10/1951 | Robinson | 49/463 |
| 3,245,572 | 4/1966 | Mashy et al. | 206/513 |
| 3,655,088 | 4/1972 | Box | 206/427 |
| 3,762,594 | 10/1973 | Utz | 220/DIG. 15 |
| 3,809,279 | 5/1974 | Arjas | 206/509 |
| 3,831,321 | 8/1974 | Johnson | 49/465 |
| 3,840,692 | 10/1974 | Wells | 220/241 |
| 3,866,787 | 2/1975 | Allegri et al. | 206/509 |
| 3,899,101 | 8/1975 | Keating et al. | 220/241 |
| 3,915,327 | 10/1975 | Lovich et al. | 220/345 |

FOREIGN PATENTS OR APPLICATIONS

| | | | |
|---|---|---|---|
| 2,041,066 | 9/1971 | Germany | 206/427 |

*Primary Examiner*—William Price
*Assistant Examiner*—Joseph M. Moy

[57] ABSTRACT

A full depth molded transport case for milk cartons having a bottom, three integrally formed upstanding sides, a fourth open side and an open top. An upper stacking rim extends around the top and across the open side of the case, and a lower stacking rim extends around the periphery of the bottom thereof. A removable panel adapted to enclose the open side of the case is disposed therein, and includes means, such as outwardly extending tongue members, adapted for engagement behind the stacking rims of the case, for releasably fastening the removable panel to the case. Removal of the panel permits access to the cartons disposed in the transport case through the open side thereof when a plurality of cases are stacked in a display stand.

4 Claims, 7 Drawing Figures

FULL DEPTH TRANSPORT CASE HAVING A REMOVABLE SIDE PANEL

BACKGROUND OF THE INVENTION

1. Field of the Invention

This invention relates generally to transport cases, and in particular to a full depth molded transport case for milk cartons having a removable side panel for permitting access to cartons disposed therein when the cases are stacked in a display stand.

2. Description of the Prior Art

Full depth molded transport cases for milk cartons and the like are generally known in the art. Generally speaking, such transport cases have a bottom, four integrally formed upstanding sides, and an open top. The disadvantage of such cases, however, is that the only access to the cartons disposed therein is through the open top of the case. Thus, if such cases are stacked one on top of the other, only the cartons in the top case are accessible for removal, and the cartons must be removed from the transport cases for display in, for example, a refrigerated dislay stand in a supermarket. It is, however, desireable that such transport cases be fabricated so as to permit the stacking thereof within such a refrigerated display stand in a supermarket and yet still provide customer access to the cartons disposed therein.

SUMMARY OF THE INVENTION

It is therefore an object of the present invention to overcome the aforementioned disadvantages of heretofore known prior art transport cases, and to provide an improved transport case which permits access to the interior space thereof when a plurality of such cases are disposed in stacked relationship.

These and other objects of the invention are achieved in a full depth transport case having a bottom and a plurality of upstanding sides in which one of the sides of the case comprises a removable panel. More specifically, the above objects are achieved in a full depth, rectangular-shaped plastic molded transport case for milk cartons and the like having a bottom, three integrally formed upstanding sides, a fourth open side and an open top. An upper stacking rim extends around the top and across the open side of the case, and a lower stacking rim extends around the periphery of the bottom thereof. The removable panel is adapted to enclose the open side of the case, and means are provided for releasably fastening the panel to the case. Removal of the panel permits removal of the milk cartons disposed in the case through the open side thereof.

In one embodiment of the transport case, the above-described means includes slotted portions disposed in at least the bottom of the case adjacent the lower stacking rim, and corresponding tongue members disposed on the panel which are receivable into the slotted portions. The tongue members may extend outwardly from the upper and lower edges of the panel, with those tongue members disposed on the upper panel edge being slidable into engagement with and behind the upper stacking rim, and those tongue members disposed on the lower panel edge being movable into the slotted portions in the lower stacking rim in a snap-fit engagement therewith.

In still another embodiment of the case, the above-described means may comprise tongue members extending outwardly from opposing edges of the removable panel, which members are adapted for disposal in engagement with and behind the upper and lower stacking rims of the transport case.

The described removable panel may also have a window provided therein which is adapted to expose printed information on the milk cartons and enable such information to be read, for example, by a computerized automatic check-out scanning system.

These and other features of the improved transport case of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 2:
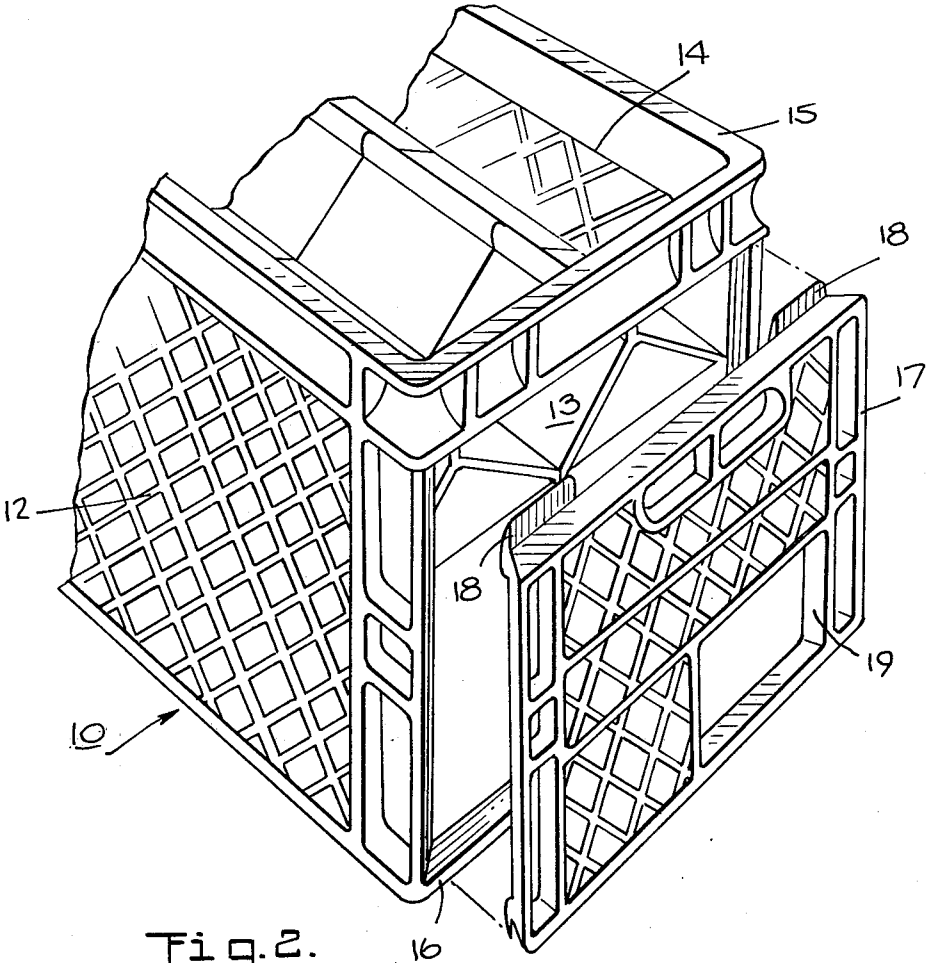
FIG. 2 is a partial, exploded perspective view of the transport case of FIG. 1, showing the panel removed from the case.
Figure 1:
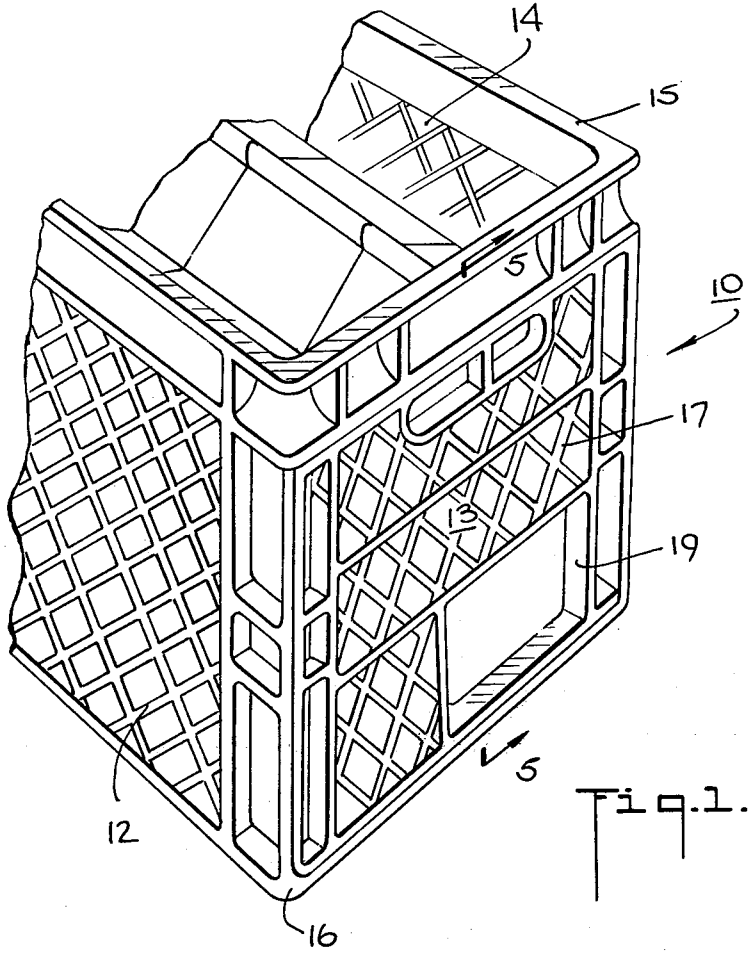
FIG. 1 is a partial, perspective view of an improved transport case constructed according to the invention, showing the removable panel thereof fastened to the case.
Figure 4:
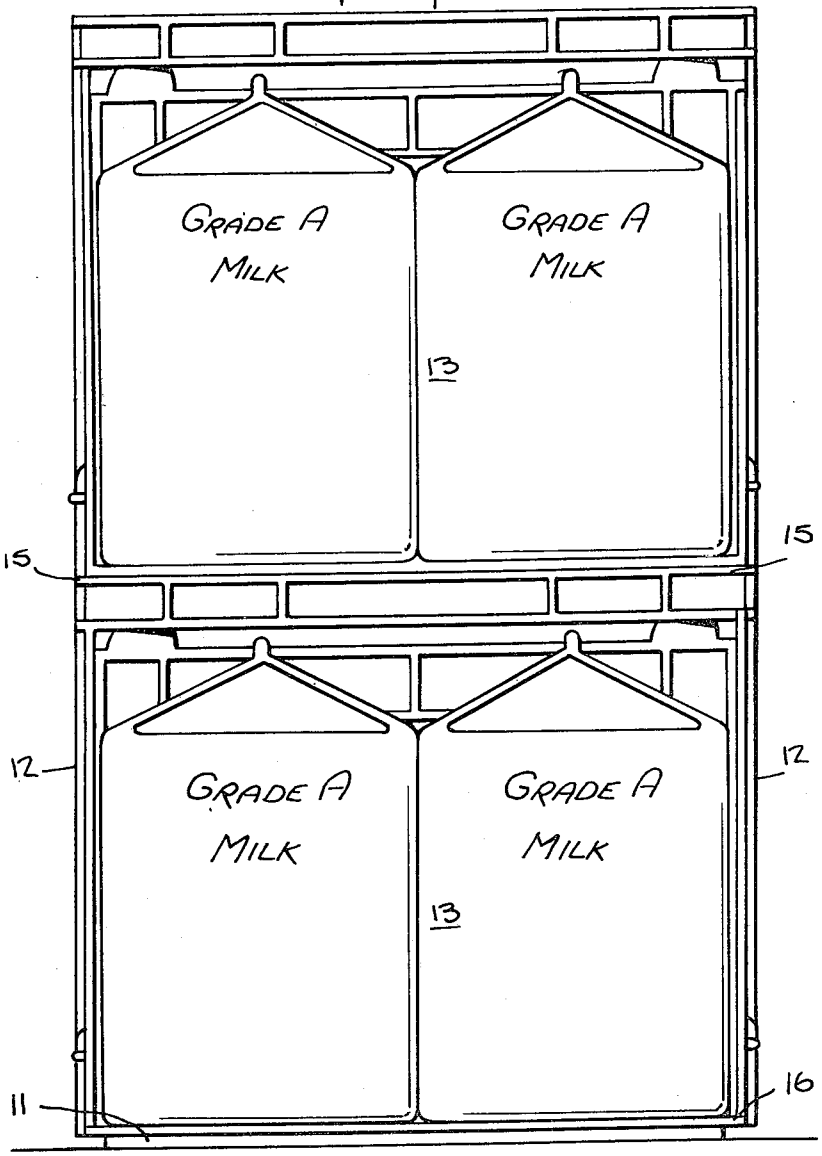
FIG. 4 is an end view of the transport cases illustrated in FIG. 3, showing the panels removed from the cases to provide access to cartons disposed therein.
Figure 3:
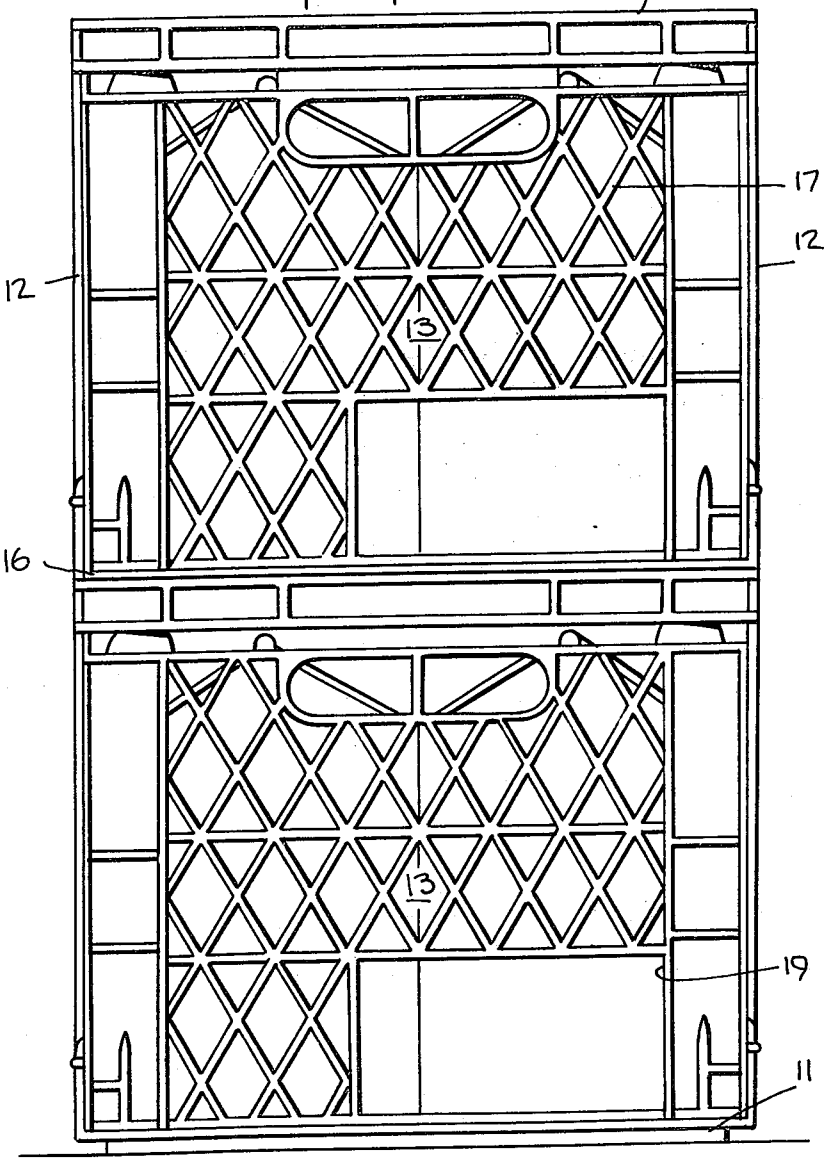
FIG. 3 is an end view of a plurality of transport cases constructed according to the invention which are disposed in stacked relationship, showing the panels thereof fastened to the cases.

Referring now to the drawings, there is shown a full depth transport case, generally designated by the numeral 10, which is rectangular in shape and is fabricated of molded plastic. The case is particularly suited for the transportation and storage of cartons, such as, for example, milk cartons, and includes a bottom 11 (shown in FIGS. 3, 4 and 5), three integrally formed upstanding sides 12, a fourth open side 13, and an open top 14. An upper stacking rim 15 extends around top 14 of the case and across open side 13 thereof, and a lower stacking rim 16 extends around the periphery of bottom 11. A removable panel 17 comprises one end of the transport case and encloses the open side 13 thereof. Suitable means for releasably joining or fastening the panel to the transport case, so that removal of the panel permits removal of the milk cartons disposed therein through the open side 13 thereof, are also provided. In the illustrated embodiment of the invention the described means comprise tongue members 18 which extend outwardly from opposing edges of panel 17 and are adapted for disposal in engagement with and behind the upper and lower stacking rims of the case. Slotted portions or slots may be provided in at least the bottom 11 of the transport case adjacent the lower stacking rim 16 for receiving the tongue members on the lower portion of the removable panel. In this latter type arrangement, the tongue members on the upper edge of panel 17 are slidable into engagement with and behind upper stacking rim 15, and the members on the lower edge of the panel are movable into a snap-fit type engagement with the slotted portions adjacent stacking rim 16. Slotted portions may additionally be provided in upper stacking rim 15 for receiving tongue members 18 on the upper edge of the panel. Finally, panel 17 may include a window or cutout 19 disposed in the lower corner thereof for exposing printed information, such as price, on the cartons, and thereby permitting the optical scanner of a computerized automatic check-out scanning system to read the price of the item. These windows may be provided on all four sides of the transport case.

Figure 5:
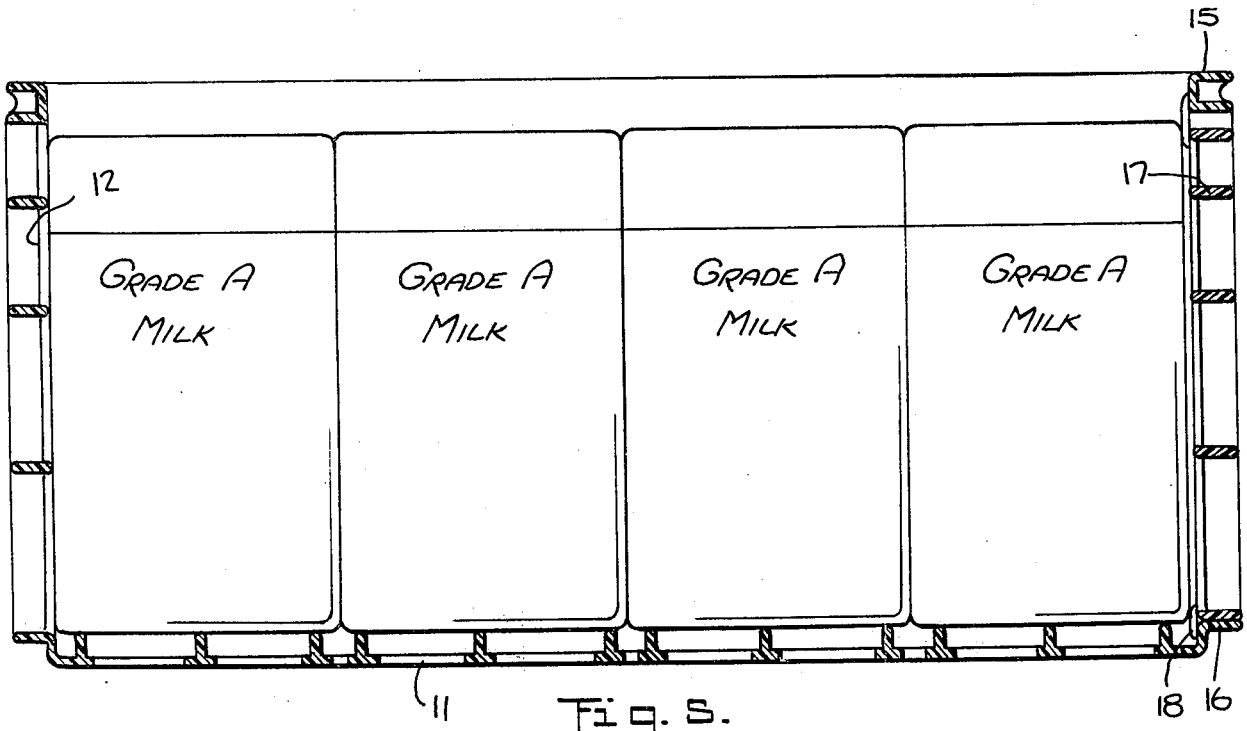
FIG. 5 is a cross-sectional view of the transport case taken along section 5—5 of FIG. 1.
Figure 6:
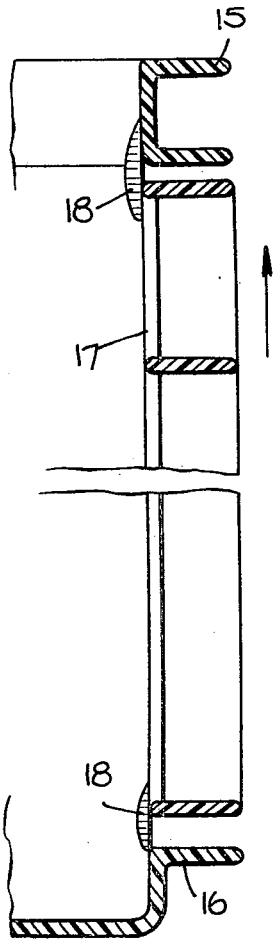
FIG. 6 is a partial, cross-sectional end view of the transport case, showing the panel in its fully inserted position.
Figure 7:
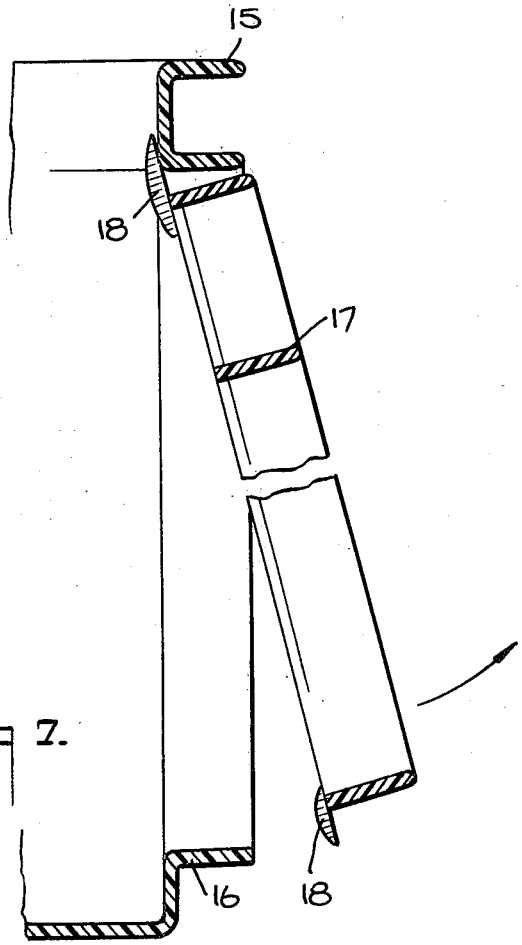
FIG. 7 is a partial, cross-sectional end view of the transport case, showing the panel in a partially removed position.

The insertion and removal of panel 17 is achieved as follows:

To insert the panel in the transport case, tongue members 18 are inserted behind the lower edge of stacking rim 15 in engagement therewith (if slots are provided in the upper rim, the tongue members are inserted therein), and the lower portion of the panel is then swung towards lower stacking rim 16. The tongue members on the lower edge of the panel are then snapped behind the lower stacking rim (if slots are provided in rim 16, the tongue members are snapped into the slots). The lateral edges of panel 17 are beveled outwardly towards the outside of the case so as to engage the edges thereof about opening 13. In this manner, the panel is releasably fastened to the transport case, as illustrated in FIGS. 5 and 6. To remove the panel from the case, the panel is slid upwardly towards upper stacking rim 15 and pulled away from the case at the bottom thereof as shown in FIG. 7. The tongue members on the upper edge of the panel can then be disengaged from stacking rim 15 and the entire panel removed from the case. With such a construction, a plurality of transport cases containing milk cartons or the like can first be stacked with the removable panels thereof all at the same end, and the panels can then be removed to permit access by customers to the cartons therein.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A full depth rectangular plastic molded transport case for milk cartons having a bottom, three integrally formed upstanding sides, a fourth open side and an open top, an upper stacking rim extending around said top and across said open side, a lower stacking rim extending around the periphery of said bottom, a removable panel disposed between and in engagement with said stacking rims adapted to entirely enclose said open side, and tongue members extending outwardly from opposing edges of said panel adapted for disposal in engagement with and behind said upper and lower stacking rims for releasably fastening said panel to said case so that said panel is completely removable from said case, whereby removal of said panel permits removal of said milk cartons through said open side.

2. In the case of claim 1, said means including slotted portions in at least said bottom of said case adjacent said lower stacking rim and corresponding tongue members disposed on said panel and receivable into said slotted portions.

3. In the case of claim 2, said tongue members extending outwardly from the upper and lower edges of said panel, the tongue members on said upper edge being slideable into engagement with and behind said upper stacking rim, and the tongue members on said lower edge being movable into a snap-fit engagement with the slotted portions in said lower stacking rim.

4. In the case of claim 3, said panel having a window at a lower portion thereof adapted to expose printed information on one of said milk cartons and thereby enable scanning thereof by a computerized automatic checkout scanning system.

* * * * *